US008279717B2

(12) United States Patent
Hirano

(10) Patent No.: US 8,279,717 B2
(45) Date of Patent: Oct. 2, 2012

(54) CALENDAR MECHANISM AND ANALOG TIMEPIECE EQUIPPED WITH SAME MECHANISM

(75) Inventor: Kei Hirano, Chiba (JP)

(73) Assignee: Seiko Instruments Inc. (JP)

( * ) Notice: Subject to any disclaimer, the term of this patent is extended or adjusted under 35 U.S.C. 154(b) by 153 days.

(21) Appl. No.: 12/925,375

(22) Filed: Oct. 20, 2010

(65) Prior Publication Data

US 2011/0090766 A1 Apr. 21, 2011

(30) Foreign Application Priority Data

Oct. 21, 2009 (JP) ..... 2009-242717

(51) Int. Cl.
*G04B 19/20* (2006.01)

(52) U.S. Cl. ..... 368/37

(58) Field of Classification Search ..... 368/28, 368/34–38

See application file for complete search history.

(56) References Cited

U.S. PATENT DOCUMENTS 4,257,113 A * 3/1981 Meister et al. ..... 368/35
6,081,483 A * 6/2000 Capt et al. ..... 368/28
6,958,952 B2 * 10/2005 Gabathuler et al. ..... 368/28
7,023,762 B1 * 4/2006 Burkhardt et al. ..... 368/35
7,180,829 B2 * 2/2007 Watanabe ..... 368/37
7,724,611 B2 * 5/2010 Groothuis et al. ..... 368/37
2007/0201312 A1 8/2007 Watanabe ..... 368/37

* cited by examiner

*Primary Examiner* — Vit W Miska
(74) *Attorney, Agent, or Firm* — Adams & Wilks

(57) ABSTRACT

To provide a calendar mechanism which can easily and reliably cause first and second date indicators to coincide in rotation phase, and an analog timepiece equipped therewith. A calendar mechanism of an analog timepiece includes a first date indicator including a first date character indication portion which indicates the ones column of the date, a first date indicator gear portion, and a drive cam portion which defines an endless ring-shaped cam face; a drive cam lever which includes a driven lever portion whose one end portion abuts against the drive cam portion, and an operating lever portion which includes a first fan-shaped gear portion at the leading end portion, the operating lever portion being pivoted in accordance with the driven lever portion; and a second date indicator which, being rotatable, includes a second date character indication portion which indicates the tens column of the date, and a second fan-shaped gear portion meshing with the first fan-shaped gear portion. The first fan-shaped gear portion and second fan-shaped gear portion have specified teeth which are brought into selective meshing engagement in a condition in which the first date indicator and second date indicator coincide in rotation phase.

20 Claims, 6 Drawing Sheets

CALENDAR MECHANISM AND ANALOG TIMEPIECE EQUIPPED WITH SAME MECHANISM

BACKGROUND OF THE INVENTION

1. Field of the Invention

The present invention relates to a calendar mechanism and an analog timepiece equipped therewith, and more particularly relates to a calendar mechanism of a so-called big date form wherein the ones column and tens column of the date are indicated with separate date indicators, as a result of which it is possible to indicate the date in large characters, and to an analog timepiece equipped with the calendar mechanism.

2. Description of the Related Art

As a calendar mechanism of a big date form, a calendar mechanism is proposed which includes a first date indicator including a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face; a drive cam lever including a driven lever portion whose one end portion abuts against the drive cam portion as a cam follower, and an operating lever portion which, being integral with the driven lever portion, includes a first fan-shaped gear portion at the leading end portion, wherein when the driven lever portion is pivoted in a condition in which the one end portion is in abutment with the cam face of the drive cam portion, the first fan-shaped gear portion of the operating lever portion is pivoted in accordance with the pivoting of the driven lever portion; and a second date indicator including a second date character indication portion which indicates the tens column of the date, and a second fan-shaped gear portion meshing with the first fan-shaped gear portion (for example, JP-A-2007-218856).

However, with the calendar mechanism proposed in JP-A-2007-218856, when the one end portion of the driven lever portion of the drive cam lever is in engagement with a specified cam surface portion (for example, a region corresponding to the dates of 01 to 09) of the drive cam portion of the first date indicator, it is indispensable that the first and second fan-shaped gear portions mesh with each other by means of their teeth in specified positions in accordance with this condition (it is indispensable that their rotation phases are caused to coincide with each other), but nevertheless, in the event that one tooth of each gear portion comes unmeshed, the first and second date indicators and drive cam lever are assembled in a condition in which this indispensable condition is not fulfilled (a noncoincidence condition), and the calendar mechanism in the noncoincidence condition causes a misalignment of the date characters of the second date indicator, thus preventing an appropriate date indication, and indicating unlikely dates such as "32nd" to "39th".

SUMMARY OF THE INVENTION

It is an aspect to provide a calendar mechanism which can easily and reliably cause a first and second date indicator to coincide in rotation phase, and an analog timepiece equipped with the calendar mechanism.

A calendar mechanism of the invention includes a first date indicator which, being rotatable around a first central axis of rotation, includes a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face; a drive cam lever which includes a driven lever portion whose one end portion abuts against the drive cam portion as a cam follower, and an operating lever portion which, being integral with the driven lever portion, includes a first fan-shaped gear portion at the leading end portion, wherein when the driven lever portion is pivoted in a condition in which the one end portion is in abutment with the cam face of the drive cam portion, the first fan-shaped gear portion of the operating lever portion is pivoted in accordance with the pivoting of the driven lever portion; and a second date indicator which, being rotatable around a second central axis of rotation, includes a second date character indication portion which indicates the tens column of the date, and a second fan-shaped gear portion meshing with the first fan-shaped gear portion, wherein the first fan-shaped gear portion and second fan-shaped gear portion have specified teeth which are brought into selective meshing engagement in a condition in which the first date indicator and second date indicator coincide in rotation phase.

With the calendar mechanism of the invention, as "the first fan-shaped gear portion and second fan-shaped gear portion have specified teeth which are brought into selective meshing engagement in a condition in which the first date indicator and second date indicator coincide in rotation phase", in the condition in which the one end portion of the driven lever portion of the drive cam lever is in engagement with a specified position of the drive cam portion of the first date indicator, simply by bring the specified teeth of the first fan-shaped gear portion and the specified teeth of the second fan-shaped gear portion into meshing engagement, it is possible to unerringly and easily position the first and second gear portions in relation to each other, and unerringly and easily position the first and second date indicators in a condition in which they coincide in rotation phase. When desired, an arrangement may be such that the specified teeth never mesh in a condition other than the phase coincidence condition (a normal position).

In the above, the first date indicator and second date indicator are typically concentric, and the first central axis of rotation and the second central axis of rotation coincide. However, when desired, the two may differ.

Also, in the above, the driven lever portion of the drive cam lever and the first fan-shaped gear portion are typically integral. However, when desired, the two do not have to be integral.

With the calendar mechanism of the invention, typically, each of the first and second fan-shaped gear portions has, in at least one portion of an arc portion of a fan, teeth of a pitch differing from that of those in the other arc portion as the specified teeth.

In this case, teeth which, being in at least one portion of the arc portion of the fan of the first fan-shaped gear portion, have a pitch differing from that of those in the other arc portion are formed of the specified teeth of the first fan-shaped gear portion, and teeth which, being in at least one portion of the arc portion of the fan of the second fan-shaped gear portion, have a pitch differing from that of those in the other arc portion are formed of the specified teeth of the second fan-shaped gear portion. In this case, by virtue of the difference in pitch, the first and second fan-shaped gear portions can be positioned in relation to each other by being brought into selective meshing engagement by means of their specified teeth. However, when desired, the specified teeth may be prescribed by a tooth shape in place of the pitch. Herein, the tooth shape can be prescribed by the width or shape of the teeth or of the hollow portions or depressed portions between the teeth.

With the calendar mechanism of the invention, typically, the pitch of the specified teeth is smaller than the pitch of teeth other than the specified teeth.

In this case, the first and second date indicators coincide in phase in only a position in which teeth of small pitch mesh with each other. However, for example, in a kind of case in which the teeth and the groove portions between the teeth are the same in size, when desired, it is acceptable that the pitch of the specified teeth is larger, instead of being smaller, than the pitch of teeth other than the specified teeth.

The calendar mechanism of the invention is typically configured in such a way that, when the first date indicator is in a pivotal position indicating the date from 01 to 09, the first fan-shaped gear portion and second fan-shaped gear portion mesh with each other by means of the specified teeth when the one end portion of the driven lever portion is in abutment with the drive cam portion.

Herein, the drive cam portion has a first arc-shaped cam face corresponding to the dates from 01 to 09, a second arc-shaped cam face corresponding to the dates from 10 to 19, a third arc-shaped cam face corresponding to the dates from 20 to 29, and a fourth arc-shaped cam face corresponding to the dates 30 and 31, and in a kind of case in which the radius of the first to fourth arc-shaped cam faces increases or decreases gradually, when one end to another region of the arc of the fan of each of the first and second fan-shaped gear portions is utilized to switch a date indication, each of the first and second fan-shaped gear portions includes the specified teeth at the one end of the arc of the fan. However, when only the intermediate portion of the arc of the fan of each of the first and second fan-shaped gear portions is utilized to switch the date indication, each of the first and second fan-shaped gear portions includes the specified teeth at one end of the intermediate portion of the arc of the fan.

With the calendar mechanism of the invention, typically, each of the first and second fan-shaped gear portions has the specified teeth at one end of the arc of the fan.

Herein, for example, in the kind of case in which the drive cam portion has the heretofore described kinds of first to fourth arc-shaped cam face, and the radius of the first to fourth arc-shaped cam faces increases or decreases gradually, when the first date indicator is in the rotational position indicating the date from 01 to 09, the first fan-shaped gear portion and second fan-shaped gear portion mesh with each other by means of the specified teeth when the one end portion of the driven lever portion is in abutment with the drive cam portion.

With the calendar mechanism of the invention, typically, the first and second central axes of rotation are formed of the same central axis of rotation, and the mechanism includes a rotation limit mechanism which exerts an elastic bias force which biases the second date indicator in one direction around the same central axis of rotation.

In this case, a possibility of a deviation in position of the second date indicator occurring can be minimized. The first date indicator can be positioned by a date jumper which carries out a jump control operation on the gear portion of the first date indicator.

With the calendar mechanism of the invention, typically, the rotation limit mechanism includes a rotation limit lever which, as well as including a spring torque receiving portion, is engaged integrally with the drive cam lever, and elastic means which imparts a one-direction torque to the spring torque receiving portion of the rotation limit lever.

In this case, the second date indicator can be accurately positioned via the rotation limit lever by the elastic means. However, an arrangement may be such that the elastic means, in place of exerting a deflection force directly on the second date indicator via the rotation limit lever, exerts a deflection force on the second date indicator via the drive cam lever from the rotation limit lever. Herein, the elastic means is typically formed of a leaf spring mounted on a main plate. However, it may be another spring or the like.

With the calendar mechanism of the invention, typically, the rotation limit lever includes another fan-shaped gear portion which meshes with the second fan-shaped gear portion.

In this case, the elastic means exerts a deflection force directly on the second date indicator via the rotation limit lever.

With the calendar mechanism of the invention, typically, the other fan-shaped gear portion is a fan-shaped gear portion of a shape coinciding with that of the first fan-shaped gear portion.

In this case, the other fan-shaped gear portion operates in mesh with the second fan-shaped gear portion in the condition in which it is superimposed on the first fan-shaped gear portion of the drive cam lever. However, in a case in which the rotation limit lever is built into the drive cam lever so that it can be displaced relative thereto, the other fan-shaped gear portion may be in mesh with the second fan-shaped gear portion in a portion (a circumferential portion of the arc) separate from a portion (a circumferential portion of the arc) in which the second fan-shaped gear portion is in mesh with the first fan-shaped gear portion.

An analog timepiece includes the heretofore described kind of calendar mechanism.

In this case, simply by bringing the specified teeth of the first and second fan-shaped gear portions into selective meshing engagement with each other, it is possible to easily and reliably cause the first and second date indicators to coincide in phase. The analog timepiece may be an electronic timepiece, or may be a mechanical timepiece.

DETAILED DESCRIPTION OF THE PREFERRED EMBODIMENTS

One preferred embodiment of the invention will be described based on one preferred embodiment shown in the attached drawings.

Figure 3:
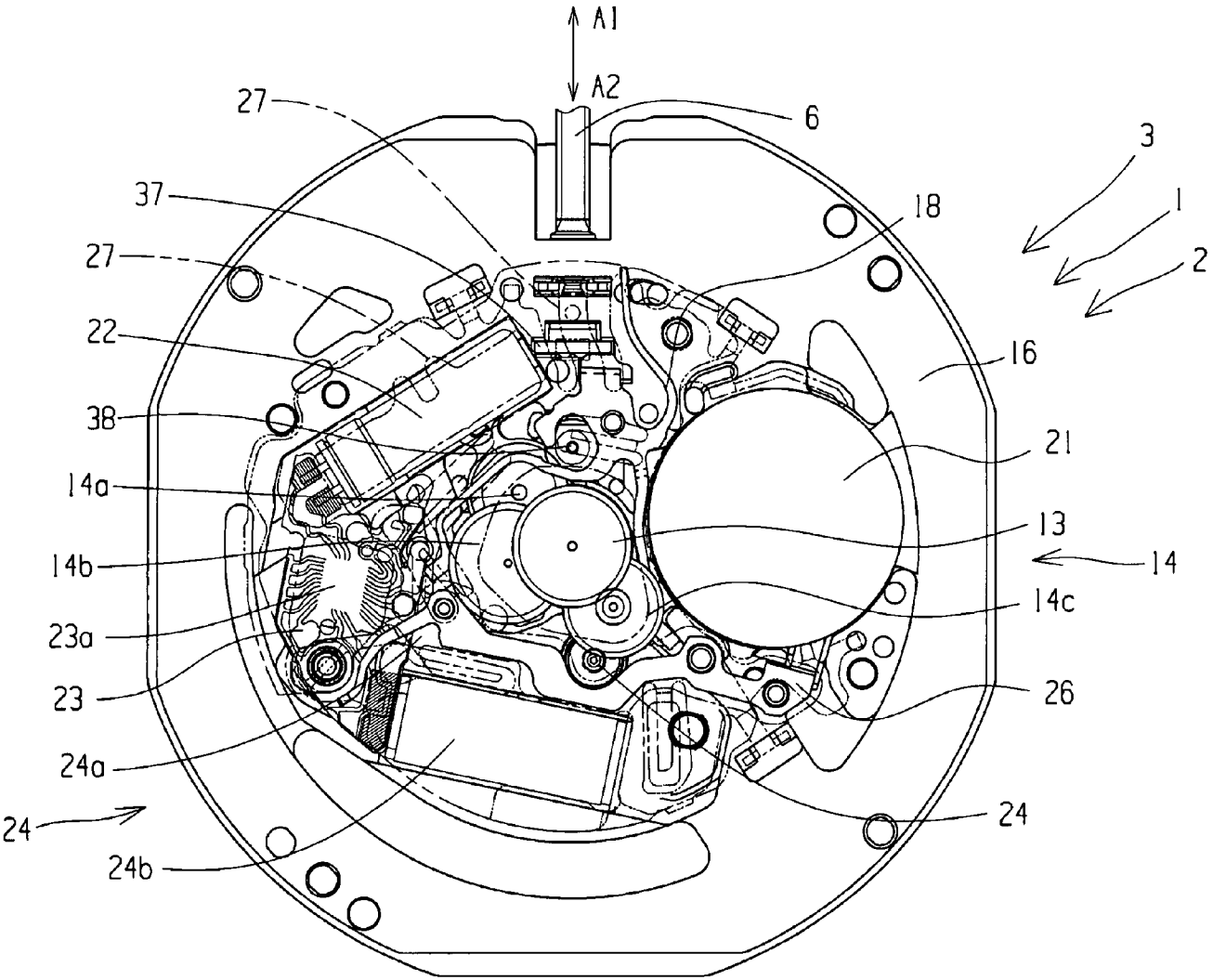
FIG. 3 is a back illustration of the main body portion of the analog timepiece of FIG. 1 seen from a back case side.
Figure 4:
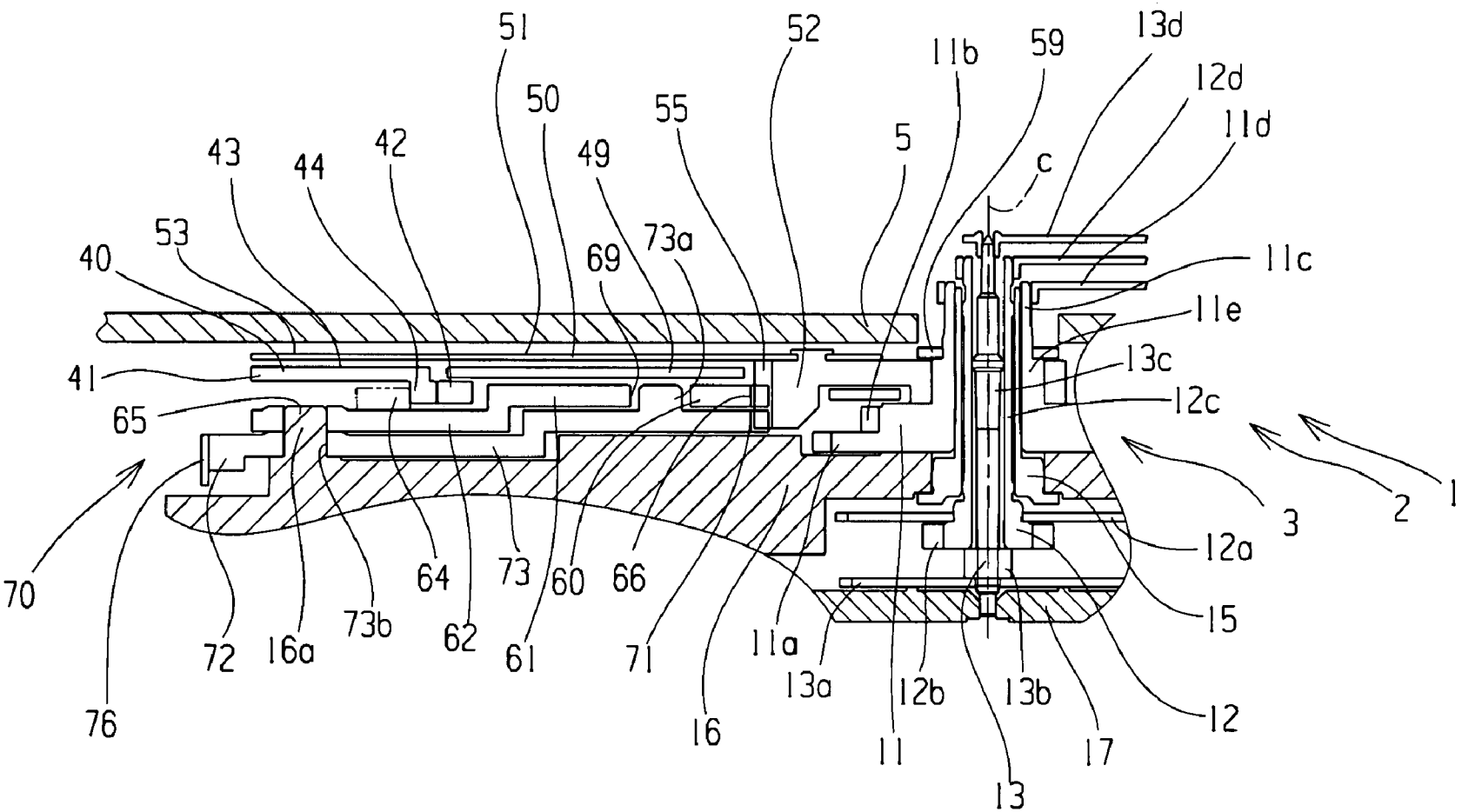
FIG. 4 is a sectional illustration showing one portion of hands and the calendar mechanism in the main body portion of the analog timepiece of FIG. 1.
Figure 5:
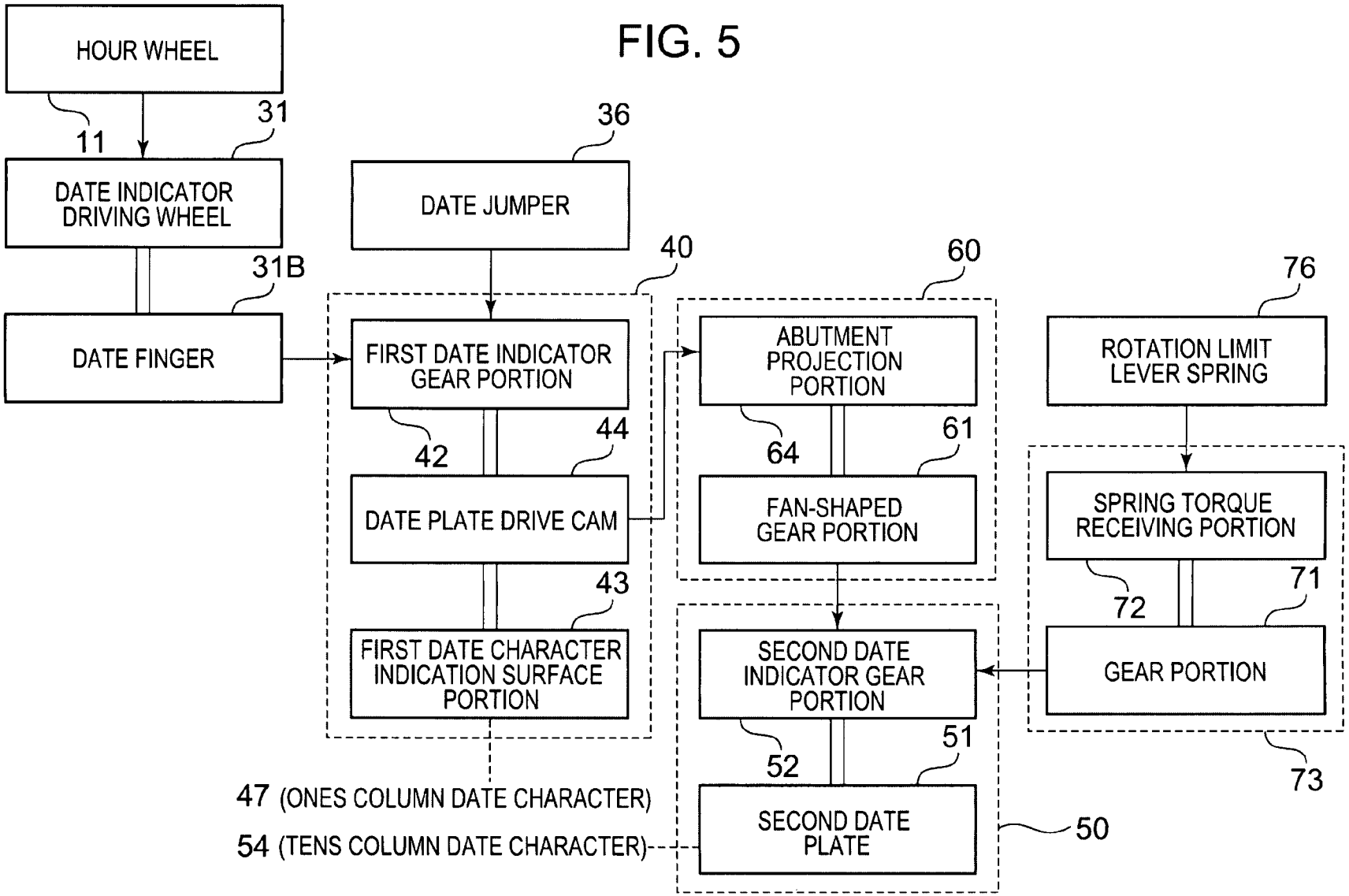
FIG. 5 is a block diagram showing an outline relationship between train wheels and the calendar mechanism of the analog timepiece of FIG. 1.

An analog timepiece 2 of one preferred embodiment of the invention including a calendar mechanism 1 of one preferred embodiment of the invention has a timepiece main body or movement 3 with substantially the kind of configuration shown in FIGS. 3 and 4. An outline relationship between train wheels and the calendar mechanism 1 of the analog timepiece 2 is shown in FIG. 5.

Figure 2:
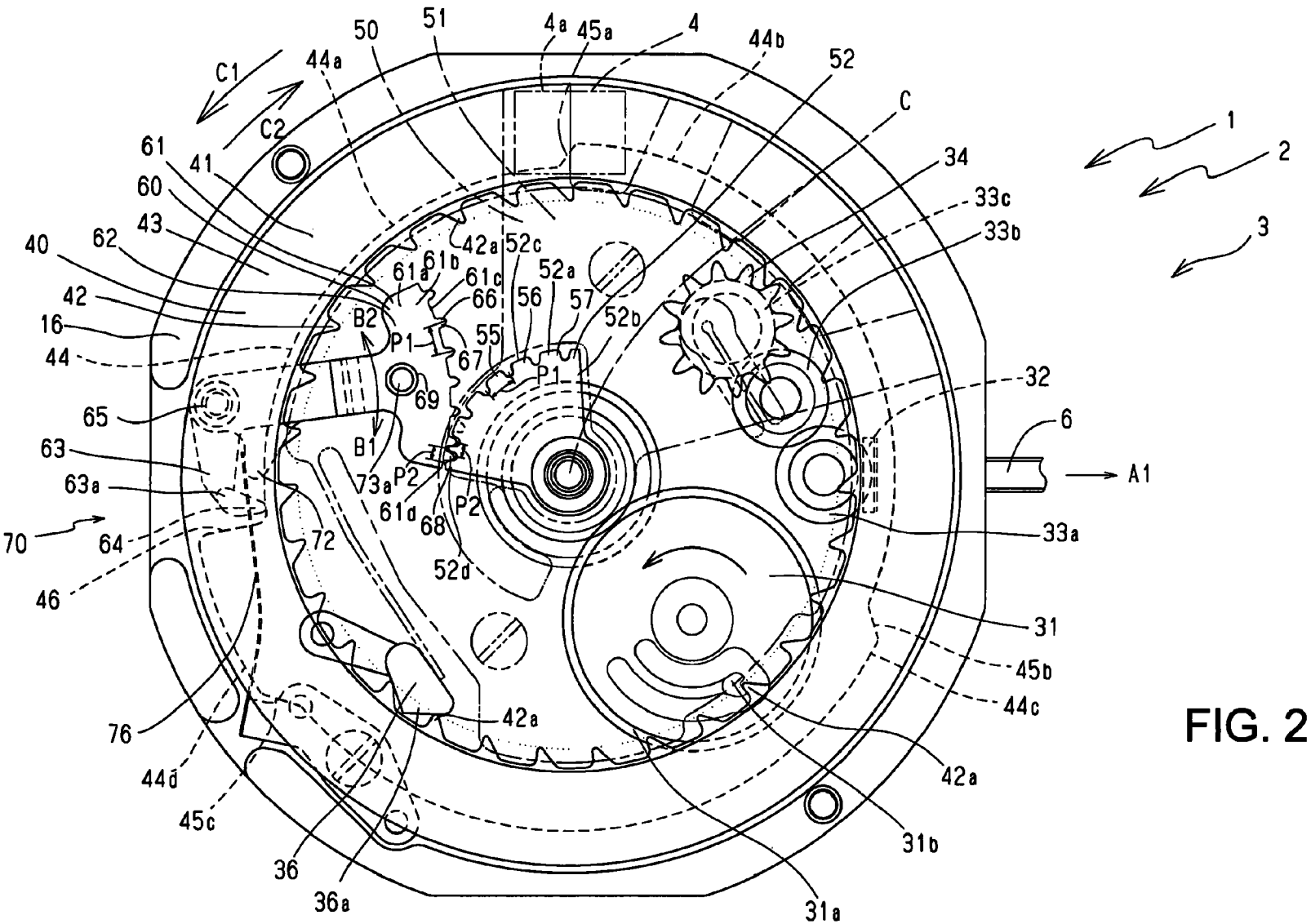
FIG. 2 is a plan illustration of a calendar mechanism of the analog timepiece of FIG. 1 seen from the dial side.
Figure 6:
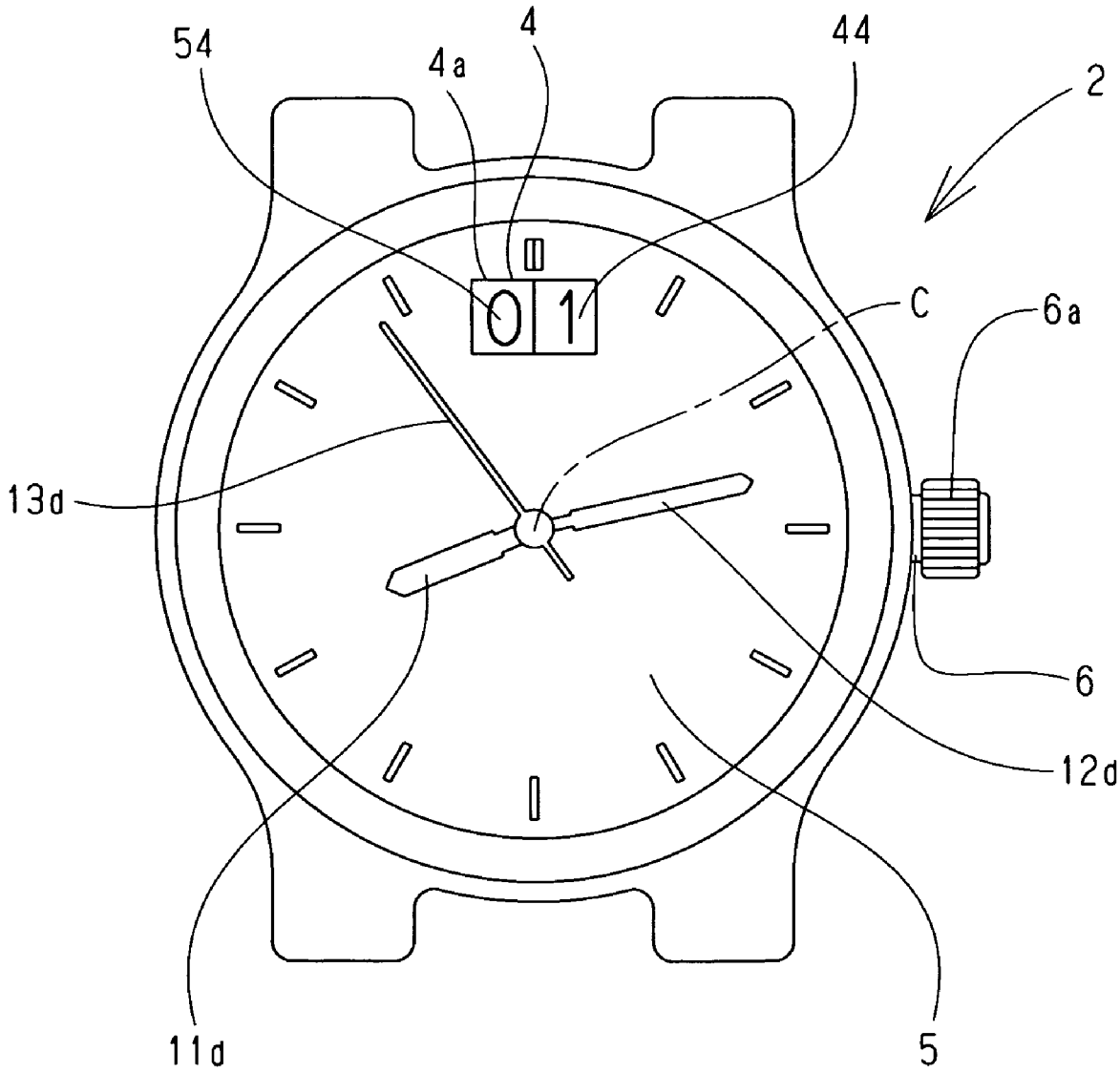
FIG. 6 is a plan illustration showing an exterior seen from the dial side of the analog timepiece of FIG. 1.

The movement 3 of the analog timepiece 2 mainly includes an hour wheel 11, a center wheel & pinion 12, and a second wheel 13 which are rotatable around a central axis C, as can be seen from FIG. 4. In FIG. 6 showing an exterior, 6*a* is a crown. Gears 11*a*, 11*b*, 12*a*, 12*b*, 13*a*, and 13*b* of the hour wheel 11, center wheel & pinion 12, and second wheel 13 are mutually meshed via train wheels 14, like a minute wheel 14*a*, a third wheel & pinion 14*b*, and a fifth wheel & pinion 14*c*, shown in FIG. 3. An hour hand 11*d* is mounted on a dial 5 side leading end portion of a cannon 11*c* of the hour wheel 11, a minute hand 12*d* is mounted on the leading end of a cannon 12*c* of the center wheel & pinion 12, and a second hand 13*d* is mounted on the leading end portion of an axle or spindle 13*c* of the second wheel 13. A minute gear 12*a* configuring the center wheel & pinion 12 is in slippable engagement with a minute pinion 12*b* integral with the cannon 12*c*. 15 is a central pipe. Herein, 16 is a main plate forming the substrate of the movement 3, and 17 is a train wheel bridge. The gears 12*a* and 12*b* of the center wheel & pinion 12 and the gears 13*a* and 13*b* of the second wheel 13 are disposed between the main plate 16 and train wheel bridge 17, and the gears 11*a* and 11*b* of the hour wheel 11 are disposed on the dial 5 side of the main plate 16. The small gear 11*b* of the hour wheel 11 forms a date indicator advancing gear meshing with a date indicator driving gear 31*a* of a date indicator driving wheel 31 (FIG. 2) as a date indicator driving pinion. In FIG. 3, 18 is a train wheel setting lever pivoted in response to a pulling out and pushing in of a setting stem 6 in A1 and A2 directions.

In a case of the kind of electronic timepiece, that is, quartz timepiece shown in FIG. 3, the analog timepiece 2 includes a crystal oscillator, which is fed with power from a battery 21 to perform an oscillation operation, or a crystal oscillator capsule 22 including this, a circuit block 23 including a timepiece integrated circuit 23*a*, and a motor 24 which rotates the hands 11*d*, 12*d*, and 13*d* via the train wheels 14 and the like. The motor 24 includes a stator 24*a*, a coil block 24*b*, and a rotor 24*c*. 26 is a battery connection (−), and 27 is a circuit maintaining plate.

The calendar mechanism 1 of the analog timepiece 2 includes a first date indicator 40, a second date indicator 50, a drive cam lever 60, and a rotation limit mechanism 70.

The first date indicator 40 includes a circular body 41 disposed so as to be rotatable around the central axis C acting as a first central axis of rotation, a first data indicator gear portion 42 connected to the inner peripheral edge of the circular body 41 via a stepped portion in a position shifted in a direction of thickness of the circular body 41, a first date character indication surface portion 43 formed of a dial 5 side main surface portion of the circular body 41, and a drive cam portion 44 which is formed along the outer peripheral surface of a stepped portion on a main surface side of the circular body 41 facing a case back and between the inner peripheral edge of the circular body 41 and the first date indicator gear portion 42.

The first date indicator gear portion 42 has 31 teeth 42*a* facing in one direction in such a way as to be rotated around the central axis C in one direction (counterclockwise as seen from the dial 5 side) C1. The C1 direction rotation of the first date indicator 40 is limited by a date indicator jumper 36 including a jump control pawl portion 36*a* which performs a jump control operation between adjacent teeth 42*a* and 42*a* of the first date indicator gear portion 42.

The drive cam portion 44 includes a first cam arc portion 44*a* following an arc with the smallest radius from a center C, a second cam arc portion 44*b* following an arc with the second smallest radius from the center C, a third cam arc portion 44*c* following an arc with the third smallest radius from the center C, and a fourth cam arc portion 44*d* with the largest radius from the center C. The arc portions 44*a*, 44*b*, 44*c*, and 44*d* extend along the angle ranges of sizes of substantially around 9/31, 10/31, 10/31, and 2/31 of the whole circumference respectively, and their regions are connected via inclined transition regions 45*a*, 45*b*, and 45*c*. A boundary surface or a stepped surface 46 extending in a substantially radial direction is formed between the fourth cam arc portion 44*d* and first cam arc portion 44*a*.

During a normal hand movement, the first date indicator 40 is engaged with a date finger 31*b* of the date indicator driving wheel 31, which is rotated in accordance with a rotation of the hour wheel 11, by means of a tooth 42*a* of the first date indicator gear portion 42, and rotated 360/31 degrees in the C1 direction once a day. At a time of a date correction, the setting stem 6 is pulled out in the A1 direction, and a rotation of the setting stem 6 is transmitted to the first date indicator gear portion 42 of the first date indicator 40 via a clutch wheel 37 and a setting wheel 38, and furthermore, via a first date corrector setting wheel or first calendar corrector setting wheel 32, a second date corrector setting intermediate wheel 33*a*, a third date corrector setting intermediate wheel 33*b*, a fourth date corrector setting intermediate wheel 33*c*, and a date corrector setting wheel 34, and the first indicator gear portion 42 is rotated in the C1 direction in accordance with the rotation of the setting stem 6, thus carrying out the date correction.

Figure 1:
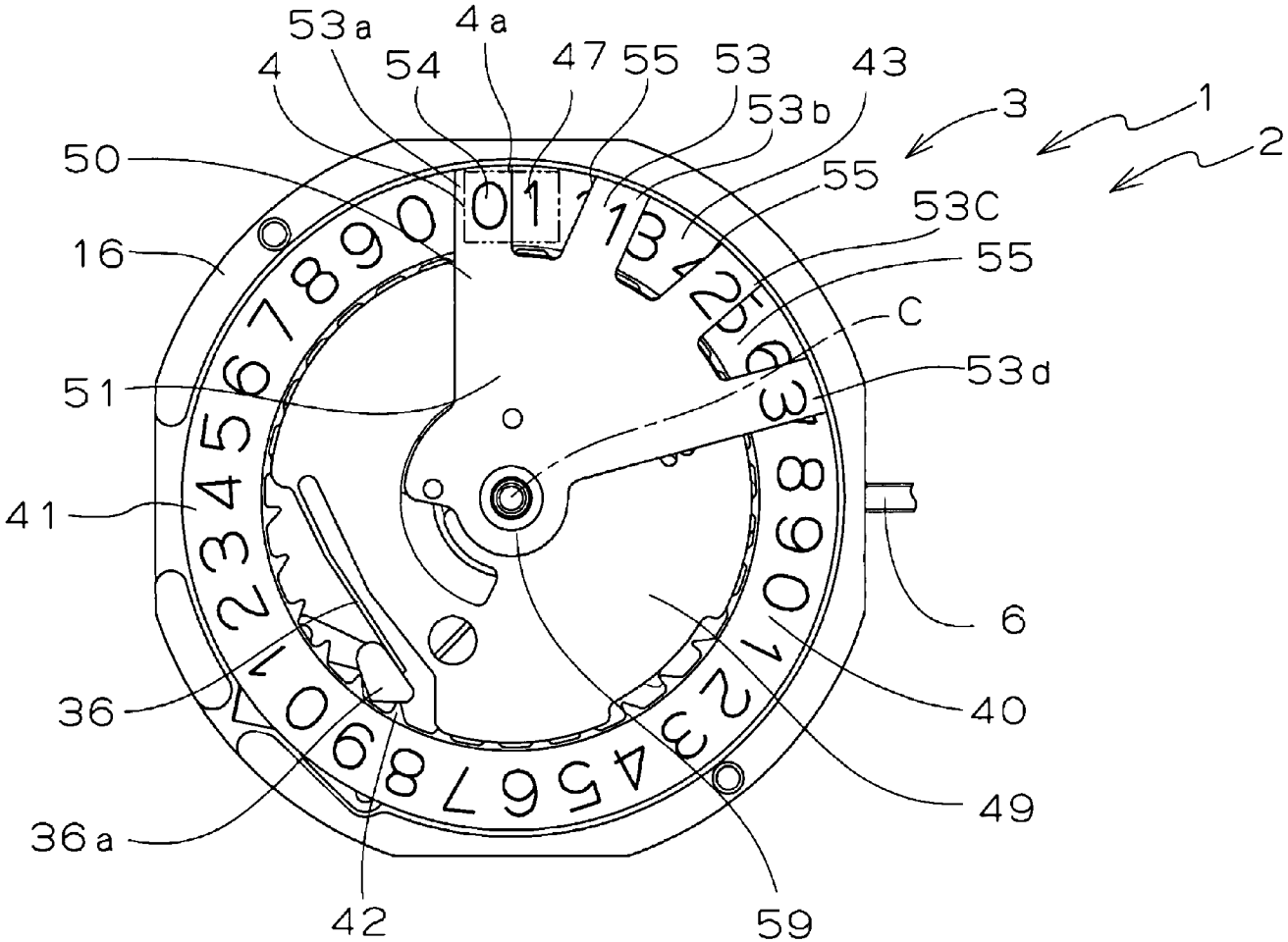
FIG. 1 is a plan illustration of a main body portion of an analog timepiece of one preferred embodiment of the invention including a calendar mechanism of one preferred embodiment of the invention, seen from a dial side.

On the first date character indication surface portion 43 acting as a first date character indication portion of the first date indicator 40, as characters forming first date characters 47, "1" is added after a string of ten characters "1, 2, 3, 4, 5, 6, 7, 8, 9, and 0" is repeated three times, and a total of 31 characters 47 are placed at regular intervals in the circumferential direction. The first date characters 47 of the first date character indication surface portion 43 indicate the ones column of the date within the right side region of a date window 4 of the dial 5, as can be seen from FIGS. 6 and 1, when the characters 47 reach the vicinity of the 12:00 position of the timepiece 2.

The first date indicator gear portion 42 of the first date indicator 40 is positioned on a side closer to the case back than to the first date character indication surface portion 43. The first date indicator 40 is lightly pressed in the substantially circular first date indicator gear portion 42 by a first date indicator cover 49 mounted on the main plate 16.

The second date indicator 50 includes a substantially fan-shaped sector plate-like body or second date plate 51 disposed so as to be rotatable around the central axis C acting as a second central axis of rotation, a date indication wheel or second date indicator gear portion 52 as a second fan-shaped gear portion or operated gear portion which, supporting the fan-shaped sector plate-like body 51 in the vicinity of the central axis C, includes small fan-shaped teeth 56 which project somewhat beyond one side of the sector plate-like body 51, and a second date character indication surface portion 53 is formed in the vicinity of the outer peripheral edge of the sector plate-like body 51. Herein, the first and second central axes of rotation are formed of the same central axis C.

The second date character indication surface portion 53 acting as a second date character indication portion has four substantially trapezoidal indication surface portions 53*a*, 53*b*, 53*c*, and 53*d* projecting via circumferential gaps 55, and characters "0, 1, 2, and 3" are put on the second date character indication surface portions 53*a*, 53*b*, 53*c*, and 53*d*, respectively, as second date characters 54. The second date characters 54 of the second date character indication surface portion 53 indicate the tens column of the date within the left side region of the date window 4 of the dial 5, as can be seen from FIGS. 6 and 1, when the characters 54 reach the vicinity of the 12:00 position of the timepiece 2.

The second date indicator gear portion 52, being of a form of a fan-shaped gear 52*a* rotatably fitted around a large diameter cannon portion 11*e* of the hour wheel 11, includes a plurality of the teeth 56 on an arc-shaped portion 52*c* of a fan 52*b*. The teeth 56, that is, the small fan-shaped teeth 56, include teeth 57 of a certain pitch (large pitch) P1 and teeth 58 of a half pitch (small pitch) P2 compared with the pitch P1. The teeth 58 of the small pitch P2 are positioned at one end (the front edge in the C1 direction) 52*d* of the arc 52*c* of the fan 52*b*, and the teeth 57 of the large pitch P1 are disposed in a portion of the arc 52*c* other than the end portion 52*d*.

During the normal hand movement, the second date indicator 50 is pivoted in the C1 direction by receiving a counterclockwise rotation drive in the second date indicator gear portion 52 every time the tens column of the date changes from 0 to 1, from 1 to 2, or from 2 to 3, and pivoted in a C2 direction by receiving a clockwise rotation drive in the second date indicator gear portion 52 when the tens column of the data changes from 3 to 0, thus indicating the tens column of the date in the left side region 4*a* of the date window 4 of the dial 5.

The second date indicator gear portion 52 of the second date indicator 50 is lightly pressed by a second indicator cover 59 fitted in the cannon 11*c* of the hour wheel 11 at the back of the dial 5.

The drive cam lever 60 integrally includes an operating lever portion 62 including a fan-shaped gear portion 61, and a driven lever portion 63 which, extending in a direction substantially perpendicular to the operating lever portion 62, includes an abutment projection portion 64 forming a cam follower in one side portion 63*a* of an extending end portion, and the drive cam lever 60 is mounted on a projection portion 16*a* of the main plate 16, in a hole portion 65 of the connection of the two lever portions 62 and 63, so as to be rotatable in B1 and B2 directions. The operating lever portion 62 includes a hole portion 69 in the fan-shaped gear portion 61.

The abutment projection portion 64 at the leading end of the driven lever portion 63 of the drive cam lever 60, as the cam follower, being in abutment with cam faces 44*a*, 44*b*, 44*c*, and 44*d* of the drive cam portion 44 of the first date indicator 40, is pivoted in the B1 and B2 directions in accordance with a radial change of position (distance from the central axis C) of the cam faces 44*a*, 44*b*, 44*c*, and 44*d* to be abutted against.

On the drive cam lever 60 being pivoted in the B1 and B2 directions, the fan-shaped gear portion 61 of the operating lever portion 62 of the drive cam lever 60 is also pivoted in the B1 and B2 directions.

The fan-shaped gear portion 61, being of a form of a substantially fan-shaped gear 61*a*, includes teeth 66 on an arc-shaped portion 61*c* of a fan 61*b*. The teeth 66, that is, a plurality of the teeth 66 arranged in a fan-like form, include teeth 67 of a certain pitch (large pitch) P1 and teeth 68 of a half pitch (small pitch) P2 compared with the pitch P1. The teeth 68 of the small pitch P2 are positioned at one end 61*d* of the arc 61*c* of the fan 61*b*, and the teeth 67 of the large pitch P1 are disposed in a portion of the arc 61*c* other than the end portion 61*d*.

The fan-shaped gear portion 61 of the drive cam lever 60 meshes with the second date indicator gear portion 52 of the second date indicator 50, and the drive cam lever 60, when pivoted in the B1 direction from a condition in which it is biased in the B2 direction, meshes with the teeth 58 of the small pitch P2 of the second date indicator gear portion 52 of the second date indicator 50 by means of the teeth 68 of the small pitch P2, and on further being pivoted in the B1 direction, meshes with the teeth 57 of the large pitch P1 of the second date indicator gear portion 52 of the second date indicator 50 by means of the teeth 67 of the large pitch P1 of the drive cam lever 60.

The rotation limit mechanism 70, being a mechanism which exerts a B2 direction bias force on the drive cam lever 60, in this example, includes a rotation limit lever 73 including a gear portion 71 meshing with the gear portion 52 of the second date indicator 50 and a torque receiving portion 72, and a leaf spring 76 as elastic means which exerts a B2 direction pivotal bias force on the rotation limit lever 73.

The rotation limit lever 73 further includes a projection portion 73*a* and a hole portion 73*b*. The rotation limit lever 73, in a condition in which it is fitted in the hole portion 69 of the operating lever portion 62 of the drive cam lever 60 by means of the projection portion 73*a*, is fitted around the projection portion 16*a* of the main plate 16, together with the operating lever portion 62 of the drive cam lever 60, by means of the hole portions 65 and 73*b*. Consequently, the rotation limit lever 73 is pivotable around the projection portion 16*a* of the main plate 16 integrally with the drive cam lever 60.

That is, the rotation limit mechanism 70 exerts the B2 direction bias force on the drive cam lever 60, and thereby exerts a C2 direction bias force on the second date indicator gear portion 52 of the second date indicator 50, thus preventing a rotational position of the second date indicator 50 from varying due to a slight backlash unavoidable in putting gears in mesh, and the second date characters from deviating from a desired indication position.

In this example, the gear portion 71 of the rotation limit lever 73 has teeth of a shape actually identical to that of the teeth 67 of the large pitch P1 of the fan-shaped gear portion 61 of the drive cam lever 60, and teeth of a shape actually identical to that of the teeth 68 of the small pitch P2 in a condition in which they are exactly aligned with each other in an extending direction of the central axis C, and when the teeth 67 of the large pitch P1 of the fan-shaped gear portion 61 of the drive cam lever 60 are in mesh with the teeth 57 of the large pitch P1 of the second date indicator gear portion 52, the gear portion 71 meshes with exactly the same teeth 57 by means of the teeth of the large pitch P1 while, when the teeth 68 of the small pitch P2 are in mesh with the teeth 58 of the small pitch P1 of the second date indicator gear portion 52, the gear portion 71 meshes with exactly the same teeth 58 by means of the teeth of the small pitch P2.

The leaf spring 76 of the rotation limit mechanism 70 applies a B2 direction torque to the torque receiving portion 72 of the rotation limit lever 73, thereby exerting the C2 direction bias force on the second date indicator 50 meshing with the gear portion 71 of the rotation limit lever 73 by means of the second date indicator gear portion 52.

Also, as the second date indicator gear portion 52 of the second date indicator 50 is biased in the C2 direction, the drive cam lever 60 meshing therewith by means of the fan-shaped gear portion 61 is also biased in the B2 direction, and the driven lever portion 63 of the drive cam lever 60 is pressed against the cam faces 44 by the abutment projection portion 64 of its leading end, thus enabling a positioning without a backlash.

In this example, as the rotation limit lever 73 is arranged in such a way as to not only be pivotable concentric with the drive cam lever 60 by means of the axle-shaped projection portion 16*a*, but also to be fitted in the hole of the drive cam lever 60 by means of the projection portion 74 and move integrally with the drive cam lever 60, it may be considered that an arrangement is such that the B2 direction pivotal bias force of the leaf spring 76 is applied to the drive cam lever 60 directly from the rotation limit lever 73.

With the analog timepiece 2 configured in the way heretofore described, when assembling the calendar mechanism 1, after building basic timepiece train wheels relating to the operation of the hands 11*d*, 12*d*, and 13*d* of the timepiece 2 mainly into the case back side of the main plate 16, as well as the date indicator driving wheel 31, the train wheels 33*a*, 33*b*, 33*c*, and 34 relating to the date correction, and the like, being built into the main plate 16, the leaf spring 76 and the like of the limit mechanism 70 are built thereinto, in a condition in which the main plate 16 is turned upside down as in the condition of FIG. 4 so that a side on which the dial 5 is disposed faces upward.

Next, a combination 60 and 73 of the drive cam lever 60 and rotation limit lever 73 is disposed in such a way that the hole portions 65 and 73*b* are fitted around the projection portion 16*a* of the main plate 16, and in such a way that a spring force of the leaf spring 76 in the B2 direction acts on the spring torque receiving portion 72 of the rotation limit lever 73.

Subsequently, the first date indicator 40 is disposed in such a way that the first date indicator gear portion 42 meshes with the date corrector setting wheel 34 in a condition in which the abutment projection portion 64 of the driven lever portion 63 of the drive cam lever 60 is in abutment with the first cam arc portion or first cam face 44*a* of the drive cam portion 44. Next, the first date indicator cover 49 is mounted thereon.

Next, the second date indicator 50 is disposed in such a way that the fan-shaped gear portion 52*a* thereof is fitted around the cannon portion 11*e* of the hour wheel 11, and the teeth 58 of a small pitch, among the teeth 56 of the second date indicator gear portion 52 thereof mesh with the teeth 66 of the fan-shaped gear portion 61 of the operating lever portion 62 of the drive cam lever 60. At this time, a certain degree of backlash is caused due to the teeth 58 of the small pitch, among the teeth 56 of the second date indicator gear portion 52, meshing with corresponding teeth but, as it is only the teeth 68 of the small pitch, among the teeth 66 of the fan-shaped gear portion 61 of the operating lever portion 62, that mesh with the teeth 58 of the small pitch, by disposing the operating lever portion 62 and second date indicator gear portion 52 in a substantially desired position, and seeking a meshing position by any means, the operating lever portion 62 and second date indicator gear portion 52 are brought into meshing engagement in a mutual phase coincidence position, and a predetermined meshing engagement free from errors is reliably realized.

As in this illustrated example, typically, with the second date indicator gear portion 52 of the second date indicator 50, as it is necessary to carry out a meshing engagement in a condition in which it is hidden behind the second date plate 51 (more specifically, between the second date plate 51 and first date indicator cover 49), whether the meshing engagement is automatized and mechanically carried out, or whether a manual assembly is made, there is no small possibility of it resulting in an erroneous assembly in the event that there is a possibility of causing a meshing engagement other than a specified meshing engagement, but only a meshing engagement between the teeth 58 and 68 of the small pitch occurs in this case, meaning that it is possible to easily and reliably cause the predetermined meshing engagement to be carried out between the fan-shaped gear portion 61 and second date indicator gear portion 52, and it is possible to adjust the first and second date indicators 40 and 50 to a predetermined rotation phase.

Herein, an arrangement may be such that teeth corresponding to the teeth 56 of the second date indicator gear portion 52 are brought into meshing engagement with the teeth 68 of the small pitch among the teeth 66 of the fan-shaped gear portion 61 of the operating lever portion 62.

In either case, in this example, by bringing the teeth 58 and 68 of the small pitch playing a positioning role into mutual meshing engagement, a relative positioning can be carried out at the same time.

In the case of this example, as the teeth 58 and 68 of the small pitch are disposed at the B2 and C1 direction end portions respectively, the meshing engagement between the teeth 58 and 68 is carried out in a condition in which the abutment projection portion 64 of the driven lever portion 63 of the drive cam lever 60 is in abutment with the first cam arc portion or first cam face 44*a* but, for example, in the event that the teeth 58 and 68 of the small pitch are disposed at the other direction end portions (the B1 direction and C2 direction end portions) respectively, the meshing engagement between the teeth 58 and 68 is carried out in a condition in which the abutment projection portion 64 of the driven lever portion 63 of the drive cam lever 60 is in abutment with the fourth cam arc portion or first cam face 44*d* of the drive cam portion 44.

As a result of this, it is possible to reliably avoid the first and second date indicators 40 and 50 being positioned in the kinds of erroneous position in which a kind of unlikely date is indicated as a big date.

Heretofore, a description has been given of an example in which the B2 direction bias force is imparted to the torque receiving portion 72 of the rotation limit lever 73 by the leaf spring 76 but, for example, a torque receiving portion corresponding to the torque receiving portion 72 being formed on the drive cam lever 60, the B2 direction bias force may be directly applied to the torque receiving portion of the drive cam lever 60 by elastic means such as the leaf spring 76. Also, in place of the rotation limit lever 73 being formed in a condition in which it is superimposed on the drive cam lever 60, an arrangement may be such that the rotation limit lever 73 is provided in a position differing from that of the drive cam lever 60 in the C1 or C2 direction, and a bias force which tends to rotate the second date indicator gear portion 52 of the second date indicator 50 in the C2 direction is applied to the torque receiving portion 72 of the rotation limit lever 73 by elastic means similar to the leaf spring 76. In this case, a gear portion of the rotation limit lever 73 which meshes with the second date indicator gear portion 52 of the second date indicator 50 may have, for example, only teeth of a large pitch which mesh with the teeth 57 of the large pitch P1.

What is claimed is:

1. A calendar mechanism, comprising:

a first date indicator which, being rotatable around a first central axis of rotation, includes a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face;

a drive cam lever which includes a driven lever portion whose one end portion abuts against the drive cam portion as a cam follower, and an operating lever portion which, being integral with the driven lever portion, includes a first fan-shaped gear portion at the leading end portion, wherein when the driven lever portion is pivoted in a condition in which the one end portion is in abutment with the cam face of the drive cam portion, the first fan-shaped gear portion of the operating lever portion is pivoted in accordance with the pivoting of the driven lever portion; and a second date indicator which, being rotatable around a second central axis of rotation, includes a second date character indication portion which indicates the tens column of the date, and a second fan-shaped gear portion meshing with the first fan-shaped gear portion, wherein the first fan-shaped gear portion and second fan-shaped gear portion have specified teeth which are brought into selective meshing engagement in a condition in which the first date indicator and second date indicator coincide in rotation phase.

2. A calendar mechanism according to claim 1, wherein each of the first and second fan-shaped gear portions has, in at least one portion of an arc portion of a fan, teeth of a pitch differing from that of those in the other arc portion as the specified teeth.

3. A calendar mechanism according to claim 2, wherein the pitch of the specified teeth is smaller than the pitch of teeth other than the specified teeth.

4. A calendar mechanism according to claim 1, configured in such a way that, when the first date indicator is in a pivotal position indicating the date from 01 to 09, the first fan-shaped gear portion and second fan-shaped gear portion mesh with each other by means of the specified teeth when the one end portion of the driven lever portion is in abutment with the drive cam portion.

5. A calendar mechanism according to claim 2, configured in such a way that, when the first date indicator is in a pivotal position indicating the date from 01 to 09, the first fan-shaped gear portion and second fan-shaped gear portion mesh with each other by means of the specified teeth when the one end portion of the driven lever portion is in abutment with the drive cam portion.

6. A calendar mechanism according to claim 3, configured in such a way that, when the first date indicator is in a pivotal position indicating the date from 01 to 09, the first fan-shaped gear portion and second fan-shaped gear portion mesh with each other by means of the specified teeth when the one end portion of the driven lever portion is in abutment with the drive cam portion.

7. A calendar mechanism according to claim 1, wherein each of the first and second fan-shaped gear portions has the specified teeth at one end of the arc of the fan.

8. A calendar mechanism according to claim 2, wherein each of the first and second fan-shaped gear portions has the specified teeth at one end of the arc of the fan.

9. A calendar mechanism according to claim 3, wherein each of the first and second fan-shaped gear portions has the specified teeth at one end of the arc of the fan.

10. A calendar mechanism according to claim 4, wherein each of the first and second fan-shaped gear portions has the specified teeth at one end of the arc of the fan.

11. A calendar mechanism according to claim 5, wherein each of the first and second fan-shaped gear portions has the specified teeth at one end of the arc of the fan.

12. A calendar mechanism according to claim 6, wherein each of the first and second fan-shaped gear portions has the specified teeth at one end of the arc of the fan.

13. A calendar mechanism according to claim 1, wherein the first and second central axes of rotation are formed of the same central axis of rotation, the mechanism comprising:

a rotation limit mechanism which exerts an elastic bias force which biases the second date indicator in one direction around the same central axis of rotation.

14. A calendar mechanism according to claim 2, wherein the first and second central axes of rotation are formed of the same central axis of rotation, the mechanism comprising:

a rotation limit mechanism which exerts an elastic bias force which biases the second date indicator in one direction around the same central axis of rotation.

15. A calendar mechanism according to claim 3, wherein the first and second central axes of rotation are formed of the same central axis of rotation, the mechanism comprising:

a rotation limit mechanism which exerts an elastic bias force which biases the second date indicator in one direction around the same central axis of rotation.

16. A calendar mechanism according to claim 4, wherein the first and second central axes of rotation are formed of the same central axis of rotation, the mechanism comprising:

a rotation limit mechanism which exerts an elastic bias force which biases the second date indicator in one direction around the same central axis of rotation.

17. A calendar mechanism according to claim 13, wherein the rotation limit mechanism includes a rotation limit lever which, as well as including a spring torque receiving portion, is engaged integrally with the drive cam lever, and elastic means which imparts a one-direction torque to the spring torque receiving portion of the rotation limit lever.

18. A calendar mechanism according to claim 17, wherein the rotation limit lever includes another fan-shaped gear portion which meshes with the second fan-shaped gear portion.

19. A calendar mechanism according to claim 18, wherein the other fan-shaped gear portion is a fan-shaped gear portion of a shape coinciding with that of the first fan-shaped gear portion.

20. An analog timepiece, comprising:

the calendar mechanism according to claim 1.

* * * * *